United States Patent [19]

El-Sayed et al.

[11] Patent Number: 5,053,306

[45] Date of Patent: Oct. 1, 1991

[54] ACID-CONTAINING A-B BLOCK COPOLYMERS AS GRINDING AIDS IN LIQUID ELECTROSTATIC DEVELOPER PREPARATION

[75] Inventors: Lyla M. El-Sayed, West Chester, Pa.; Loretta A. G. Page, Newark, Del.

[73] Assignee: E. I. Du Pont de Nemours and Company, Wilmington, Del.

[21] Appl. No.: 489,650

[22] Filed: Mar. 7, 1990

[51] Int. Cl.[5] ..... G03G 9/12; G03G 9/13

[52] U.S. Cl. ..... 430/137

[58] Field of Search ..... 430/137, 115

[56] References Cited

U.S. PATENT DOCUMENTS

| | | | |
|---|---|---|---|
| 4,631,244 | 12/1986 | Mitchell | 430/137 |
| 4,707,429 | 11/1987 | Trout | 430/115 |
| 4,957,844 | 9/1990 | Page | 430/115 |

*Primary Examiner*—Roland Martin

[57] ABSTRACT

Process for the preparation of toner particles for electrostatic liquid developers comprising (A) dispersing at ambient temperature colorant, A-B diblock polymer grinding aid as described, and a carrier liquid;

(B) adding to the dispersion a thermoplastic resin and dispersing at an elevated temperature to plasticize and liquify the resin;

(C) cooling the dispersion as described while grinding with particulate media, (D) separating the dispersion of toner particles average by area particle size less than 10 μm, from the particulate media, and (E) adding during or subsequent to step (B) at least one ionic or zwitterionic charge director compound.

Steps (A) and (B) can be combined by adding the thermoplastic resin to the other ingredients and dispersing at an elevated temperature. The liquid developer can be prepared omore quickly by the process than by other known processes. The liquid developers are useful in copying, in making color proofs, etc.

42 Claims, No Drawings

ACID-CONTAINING A-B BLOCK COPOLYMERS AS GRINDING AIDS IN LIQUID ELECTROSTATIC DEVELOPER PREPARATION

DESCRIPTION

1. TECHNICAL FIELD

This invention relates to a process for the preparation of toner particles. More particularly this invention relates to a process for the preparation of toner particles in a liquid medium for electrostatic imaging wherein A-B block copolymers are used as grinding aids.

2. BACKGROUND OF THE INVENTION

It is known to develop a latent electrostatic image with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0 and a high vapor pressure. The toner particles are 10 μm determined by a Horiba Particle Size Analyzer. After the latent electrostatic image has been formed, the image is developed by the colored toner particles dispersed in said nonpolar liquid and the image may subsequently be transferred to a carrier sheet.

There are many methods of making liquid developers. In one method of preparation of the improved toner particles are prepared by dissolving one or more polymers in a nonpolar dispersant, together with particles of a pigment, e.g., carbon black. The solution is cooled slowly, while stirring, whereby precipitation of particles occurs. It has been found that by repeating the above process toner particles were observed that were greater than 1 mm in size. By increasing the ratio of solids to nonpolar liquid the toner particles can be controlled within the desired size range, but it has been found that the density of images produced may be relatively low and when a transfer is made to a carrier sheet, for example, the amount of image transferred thereto may be relatively low. The particles in this process are formed by a precipitation mechanism and not grinding, e.g., in the presence of particulate media, and this contributes to the formation of an inferior liquid developer.

In another method of preparation of toner particles, the plasticizing of the thermoplastic polymer and pigment with a nonpolar liquid forms a gel or solid mass which is shredded into pieces, more nonpolar liquid is added, the pieces are wet-ground into particles, and grinding is continued which is believed to pull the particles apart to form fibers extending therefrom. While this process is useful in preparing improved liquid developers, it requires long cycle times and excessive material handling, i.e., several pieces of equipment are used. In yet another method of preparation of toner particles for electrostatic imaging, the following steps are followed:

A. dispersing at an elevated temperature in a vessel a thermoplastic resin, a nonpolar liquid having a Kauri-butanol value of less than 30, and optionally a colorant, by means of moving particulate media whereby the moving particulate media creates shear and/or impact, while maintaining the temperature in the vessel at a temperature sufficient to plasticize and liquify the resin and below that at which the nonpolar liquid boils and the resin and/or colorant decomposes, B. cooling the dispersion to permit precipitation of the resin out of the dispersant, the particulate media being maintained in continuous movement during and subsequent to cooling whereby the toner particles are 10 μm and a plurality of fibers are formed, and C. separating the dispersion of toner particles from the particulate media.

This method provides toners with the required particle size but requires long grinding times to achieve the desired particle size.

It has been found that the above disadvantages can be overcome and toner particles having a particle size of 10 μm as determined by a Horiba Particle Analyzer described below are prepared, with greatly reduced grinding times, by a process wherein A-B block polymers described more fully below are used as grinding aids. Transfer of an image of an electrostatic liquid developer containing the toner particles to a carrier sheet results in transfer of a substantial amount of the image providing a suitably dense copy or reproduction.

SUMMARY OF THE INVENTION

In accordance with this invention there is provided a process for the preparation of toner particles for electrostatic liquid developers comprising:

(A) dispersing at ambient temperature in a vessel, a colorant, a nonpolar liquid having a Kauri-butanol value of less than 30 and an A-B diblock polymer wherein the A block is a carboxylic acid-containing polymer and the B block is a polymer or copolymer which is soluble in the nonpolar liquid;

(B) adding to the dispersion a thermoplastic resin and dispersing at an elevated temperature sufficient to plasticize and liquify the resin and below that at which the nonpolar liquid degrades and the resin and/or colorant decomposes;

(C) cooling the dispersion, either (1) without stirring to form a gel or solid mass and grinding by means of particulate media;

(2) with stirring to form a viscous mixture and grinding by means of particulate media; or (3) while grinding by means of particulate media to prevent the formation of a gel or solid mass;

(D) separating the dispersion of toner particles having an average by area particle size of less than 10 μm from the particulate media, and (E) adding to the dispersion during or subsequent to Step (B) at least one nonpolar liquid soluble ionic or zwitterionic charge director compound.

The process of this invention results in toner particles adapted for electrophoretic movement through a nonpolar liquid.

The toner particles are prepared from at least one thermoplastic polymer or resin, suitable colorants and nonpolar liquids as described in more detail below. At least one charge director compound is present in the liquid developer. Additional components can be added, e.g., adjuvants, polyethylene, fine particle size oxides such as silica, etc., all as described more fully below.

Number average degree of polymerization (DP) means the average number of monomeric units per polymer chain. It is related to the number average molecular weight ($M_n$) by the formula: $Mn = M_o X DP$, where $M_o$ is the molecular weight of the monomer. Number average molecular weight can be determined by known osmometry techniques.

The nonpolar liquids are, preferably, branched-chain aliphatic hydrocarbons and more particularly, Isopar®-G, Isopar®-H, Isopar®-K, Isopar®-L, Isopar®-M and Isopar®-V. These hydrocarbon liquids are narrow cuts of isoparaffinic hydrocarbon fractions with extremely high levels of purity. For example, the boiling range of Isopar®-G is between 157° C. and 176° C., Isopar®-H between 176° C. and 191° C., Isopar®-K between 177° C. and 197° C., Isopar®-L between 188° C. and 206° C. and Isopar®-M between 207° C. and 254° C. and Isopar®-V between 254.4° C. and 329.4° C. Isopar®-L has a mid-boiling point of approximately 194° C. Isopar®-M has a flash point of 80° C. and an autoignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar®12, Norpar®13 and Norpar®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar® 12 | 69 | 204 |
| Norpar® 13 | 93 | 210 |
| Norpar® 15 | 118 | 210 |

All of the nonpolar liquids have an electrical volume resistivity in excess of $10^9$ ohm centimeters and a dielectric constant below 3.0. The vapor pressures at 25° C. are less than 10 Torr. Isopar®-G has a flash point, determined by the tag closed cup method, of 40° C., Isopar®-H has a flash point of 53° C. determined by ASTM D 56. Isopar®-L and Isopar®-M have flash points of 61° C., and 80° C., respectively, determined by the same method. While these are the preferred nonpolar liquids, the essential characteristics of all suitable nonpolar liquids are the electrical volume resistivity and the dielectric constant. In addition, a feature of the nonpolar liquids is a low Kauri-butanol value less than 30, preferably in the vicinity of 27 or 28, determined by ASTM D 1133. The ratio of resin to nonpolar liquid is such that the combination of ingredients becomes fluid at the working temperature. In use, the nonpolar liquid is present in an amount of 80 to 99.9% by weight, preferably 97 to 99.5% by weight, based on the total weight of liquid developer. The total weight of solids in the liquid developer is 0.1 to 20%, preferably 0.5 to 3.0% by weight. The total weight of solids in the liquid developer is solely based on the resin, including components dispersed therein, e.g., pigment component, adjuvant, etc.

Useful thermoplastic resins or polymers include: ethylene vinyl acetate (EVA) copolymers (Elvax®resins, E. I. du Pont de Nemours and Company, Wilmington, DE), copolymers of ethylene and an $\alpha,\beta$-ethylenically unsaturated acid selected from the group consisting of acrylic acid and methacrylic acid, copolymers of ethylene (80 to 99.9%)/acrylic or methacrylic acid (20 to 0%)/alkyl (C1 to C5) ester of methacrylic or acrylic acid (0 to 20%), polyethylene, polystyrene, isotactic polypropylene (crystalline), ethylene ethyl acrylate series sold under the trademark Bakelite®DPD 6169, DPDA 6182 Natural and DTDA 9169 Natural by Union Carbide Corp., Stamford, CN; ethylene vinyl acetate resins, e.g., DQDA 6479 Natural and DQDA 6832 Natural 7 also sold by Union Carbide Corp.; Surlyn®ionomer resin by E. I. du Pont de Nemours and Company, Wilmington, DE, etc., or blends thereof. Preferred copolymers are the copolymer of ethylene and an $\alpha,\beta$-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid-containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid no. is milligrams potassium hydroxide required to neutralize 1 gram of polymer. The melt index (g/10 minute) of to 500 is determined by ASTM D 1238 Procedure A. Particularly preferred copolymers of this type have an acid number of 66 and 54 and a melt index of 100 and 500 determined at 190° C., respectively.

Also useful as the resin component are copolymers of acrylic or methacrylic acid and at least one alkyl ester of acrylic or methacrylic acid wherein alkyl is 1 to 20 carbon atoms, e.g., a copolymer of methyl methacrylate (50 to methacrylic acid (0–20%) ethylhexyl acrylate (10 to 50%), wherein the percentages are by weight.

In addition, the resins have the following preferred characteristics:

1. Be able to disperse the colorant, e.g., pigment; adjuvant, e.g., metallic soap, etc.

2. Be substantially insoluble in the dispersant liquid at temperatures below 40° C., so that the resin will not dissolve or solvate in storage, 3. Be able to solvate at temperatures above 50° C., 4. Be able to be ground to form particles between 0.1 μm and 5 μm, in diameter (preferred size), e.g., determined by Horiba CAPA-500 centrifugal automatic particle analyzer, manufactured by Horiba Instruments, Inc., Irvine, CA; and between 1 μm and 15 μm, in diameter, e.g., determined by Malvern 3600E Particle sizer, manufactured by Malvern, Southborough, MA, 5. Be able to form a particle (average by area) of less than 10 μm, e.g., determined by Horiba CAPA-500 centrifugal automatic particle analyzer, manufactured by Horiba Instruments, Inc., Irvine, CA: solvent viscosity of 1.24 cps, solvent density of 0.76 g/cc, sample density of 1.32 using a centrifugal rotation of 1,000 rpm, a particle size range of 0.01 μm to less than 10 μm, and a particle size cut of 1.0 μm, and 30 μm average particle size determined by Malvern 3600E Particle Sizer as described above, 6. Be able to fuse at temperatures in excess of 70° C. By solvation in 3. above, the resins forming the toner particles will become swollen or gelatinous.

Suitable nonpolar liquid soluble ionic or zwitterionic charge director compounds (C), which are generally used in an amount of 0.25 to 1500 mg/g, preferably 2.5 to 400 mg/g developer solids, include: negative charge directors, e.g., lecithin, Basic Calcium Petronate® Basic Barium Petronate®oil-soluble petroleum sulfonate, manufactured by Sonneborn Division of Witco Chemical Corp., New York, NY, alkyl succinimide (manufactured by Chevron Chemical Company of California); positive charge directors, e.g., anionic glycerides such as Emphos®D70-30C, Emphos®F27-85, etc. manufactured by Witco Chemical Corp., NY, NY, etc.

As indicated above, colorants are dispersed in the resin. Colorants, such as pigments or dyes and combinations thereof, are preferably present to render the latent image visible. The colorant, e.g., a pigment, may be present in the amount of up to about 60 percent by weight based on the total weight of developer solids, preferably 0.01 to 30% by weight based on the total weight of developer solids. The amount of colorant may vary depending on the use of the developer. Examples of pigment include:

Pigment List

| Pigment Brand Name | Manufacturer | Colour Index Pigment |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| Hansa Yellow RA | Hoechst | Yellow 73 |
| Hansa Brilliant Yellow 5GX-02 | Hoechst | Yellow 74 |
| Dalamar ® Yellow YT-858-D | Heubach | Yellow 74 |
| Hansa Yellow X | Hoechst | Yellow 75 |
| Novoperm ® Yellow HR | Hoechst | Yellow 83 |
| Chromophtal ® Yellow 3G | Ciba-Geigy | Yellow 93 |
| Chromophtal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Chromophtal ® Yellow 8G | Ciba-Geigy | Yellow 128 |
| Irgazin ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| L74-1357 Yellow | Sun Chem. | Yellow 14 |
| L75-1331 Yellow | Sun Chem. | Yellow 17 |
| L75-2337 Yellow | Sun Chem. | Yellow 83 |
| Hostaperm ® Orange GR | Hoechst | Orange 43 |
| Paliogen ® Orange | BASF | Orange 51 |
| Irgalite ® Rubine 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heliogen ® Blue L 6901F | BASF | Blue 15:2 |
| Heliogen ® Blue NBD 7010 | BASF | Blue:3 |
| Heliogen ® Blue K 7090 | BASF | Blue 15:3 |
| Heliogen ® Blue L 7101F | BASF | Blue 15:4 |
| Paliogen ® Blue L 6470 | BASF | Blue 60 |
| Heliogen ® Green K 8683 | BASF | Green 7 |
| Heliogen ® Green L 9140 | BASF | Green 36 |
| Monastral ® Violet R | Ciba-Geigy | Violet 19 |
| Monastral ® Red B | Ciba-Geigy | Violet 19 |
| Quindo ® Red R6700 | Mobay | Violet 19 |
| Quindo ® Red R6713 | Mobay | |
| Indofast ® Violet | Mobay | Violet 23 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont | White 6 |
| Mogul L | Cabot | Black, CI 77266 |
| Uhlich ® BK 8200 | Paul Uhlich | Black (Black- |

-continued

Pigment List

| Pigment Brand Name | Manufacturer | Colour Index Pigment |
|---|---|---|
| | | ness Index 155) |

Other ingredients may be added to the electrostatic liquid developer, such as fine particle size inorganic oxides, e.g., silica, alumina, titania, etc.; preferably in the order of 0.5 μm or less can be dispersed into the liquefied resin. These oxides can be used instead of the colorant or in combination with the colorant. Metal particles can also be added.

Another additional component of the electrostatic liquid developer is an adjuvant which can be selected from the group of polyhydroxy compound which contains at least 2 hydroxy groups, aminoalcohol, polybutylene succinimide, metallic soap, and aromatic hydrocarbon having a Kauri-butanol value of greater than 30. The adjuvants are generally used in an amount of 1 to 1000 mg/g, preferably 1 to 200 mg/g developer solids. Examples of the various above-described adjuvants include:

polyhydroxy compounds: ethylene glycol, 2,4,7,9-tetramethyl-5-decyn-4,7-diol, poly(propylene glycol), pentaethylene glycol, tripropylene glycol, triethylene glycol, glycerol, pentaerythritol, glycerol-tri-12 hydroxystearate, ethylene glycol monohydroxystearate, propylene glycerol monohydroxystearate, etc., as described in Mitchell U.S. Pat. No. 4,734,352.

animoalcohol compounds: triisopropanolamine, triethanolamine, ethanolamine, 3-amino-1-propanol, o-aminophenol, 5-amino-1-pentanol, tetra(2hydroxyethyl-)ethylenediamine, etc., as described in Larson U.S. Pat. No. 4,702,985.

polybutylene/succinimide: OLOA®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc. These adjuvants are described in El-Sayed and Taggi U.S. Pat. No. 4,702,984.

metallic soap: aluminum tristearate; aluminum disearate; barium, calcium, lead and zinc stearates; cobalt, manganese, lead and zinc linoleates; aluminum, calcium and cobalt octoates; calcium and cobalt oleates; zinc palmitate; calcium cobalt, manganese, lead and zinc naphthenates; calcium, cobalt, manganese, lead and zinc resinates; etc. The metallic soap is dispersed in the thermoplastic resin as described in Trout, U.S. Pat. Nos. 4,707,429 and 4,740,444.

aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of C9 and C10 alkyl-substituted benzenes manufactured by Exxon Corp., etc., as described in Mitchell U.S. Pat. No. 4,631,244.

The disclosures of the above-listed U.S. patents describing the adjuvants are incorporated herein by reference.

The particles in the electrostatic liquid developer have an average by area particle size of less than 10 μm, preferably the average by area particle size is less than 5 μm determined by the Horiba instrument described above. Preferably the particles are ground in the range of 1 μm average particle size. The resin particles of the developer may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, bristles, or the like.

In carrying out the process of the invention useful grinding aids include A-B diblock polymers wherein the A block is a carboxylic acid-containing polymer and the B block is a polymer or copolymer which is soluble in the the dispersant nonpolar liquid. The B block has a number average molecular weight (determined by known osmometry techniques) in the range of about 2000 to 50,000. The weight percent of the A block being 5 to 40% of the polymer, and preferably 10–25%. The A-B diblock polymers are soluble in the dispersant nonpolar liquid.

The A-B polymers can be advantageously produced by stepwise polymerization process such as anionic or group transfer polymerization as described in Webster, U.S. Pat. No. 4,508,880, the disclosure of which is incorporated herein by reference. Polymers so produced have very precisely controlled molecular weights, block sizes and very narrow molecular weight distributions, e.g., weight average molecular weight divided by number average molecular weight. Weight average molecular weight can be determined by gel permeation chromatography (GPC). The A-B diblock copolymer charge directors can also be formed by free radical polymerization wherein the initiation unit is comprised of two different moieties which initiate polymerization at two distinctly different temperatures. However, this method suffer from contamination of the block copolymers with homopolymer and coupled products.

The A-B diblock copolymers can also be prepared by conventional anionic polymerization techniques, in which a first block of the copolymer is formed, and, upon completion of the first block, a second monomer stream is started to form a subsequent block of the polymer. The reaction temperatures using such techniques should be maintained at a low level, for example, 0 to −40° C., so that side reactions are minimized and the desired blocks, of the specified molecular weights, are obtained.

More specifically the A block is an alkyl, aryl, or alkylaryl carboxylic acid-containing polymer, wherein the alkyl, e.g., 1 to 200 carbon atoms, aryl, e.g., 6 to 30 carbon atoms, or alkylaryl, e.g., 7 to 200 carbon atoms, moiety can be substituted or unsubstituted. Examples of substituents include: Cl, F, Br, I, NO2, OCH3, OH, etc. Examples of useful A blocks are polymers prepared from methacrylic acid, acrylic acid, 2-, 3-, or 4-vinyl benzoic acid, etc.

Useful B blocks are polymers prepared from at least one monomer selected from the group consisting of butadiene, isoprene and compounds of the general formulas CH2=CCH3CO2R and CH2=CHCO2R wherein R is alkyl of 8–30 carbon atoms. Examples of monomers useful in preparing B blocks include: 2-ethylhexyl methacrylate, lauryl methacrylate, stearyl methacrylate, butadiene, isoprene, ethylhexyl acrylate, lauryl acrylate, etc.

Useful A-B diblock polymer grinding aids include: the diblock polymer of polymethacrylic acid and polyethylhexyl methacrylate, poly(4-vinyl benzoic acid) and polybutadiene; polyacrylic acid and polylauryl methacrylate; polymethacrylic acid and ethylhexyl acrylate; poly(2-vinyl benzoic acid) and polyisoprene; poly(3-vinyl benzoic acid) and polystearyl methacrylate, etc. The A-B diblock polymers are present in the amount of 5% to 40%, preferably 10 to 30%, most preferably 20% of developer solids.

The optimum A-B diblock structure is dependent on the components used to prepare the liquid electrostatic developers. To optimize the grinding aid structure the size of the A and B polymer blocks, as well as the ratio between A and B can be changed.

In carrying out the process of the invention, a suitable mixing or blending vessel, e.g., attritor, heated ball mill, heated vibratory mill such as a Sweco Mill manufactured by Sweco Co., Los Angeles, CA, equipped with particulate media, for dispersing and grinding, etc., is used. Generally the resin, colorant, and nonpolar liquid are placed in the vessel prior to starting the dispersing step at a percent solids of at least 20%. Optionally the colorant can be added after homogenizing the resin and the nonpolar liquid. Preferably, the colorant, e.g., pigment, is predispersed with the A-B diblock polymer in the presence of nonpolar liquid and this predispersion is dispersed with the thermoplastic resin. A polar additive having a Kauri-butanol value of at least 30, as described in Mitchell U.S. Pat. No. 4,631,244, the disclosure of which is incorporated herein by reference, can also be present in the vessel, e.g., up to 100% based on the weight of nonpolar liquid. The dispersing step is generally accomplished at elevated temperature, i.e., the temperature of ingredients in the vessel being sufficient to plasticize and liquefy the resin but being below that at which the nonpolar liquid or polar additive, if present, degrades and the resin and/or colorant decomposes. A preferred temperature range is 80 to 120° C. Other temperatures outside this range may be suitable, however, depending on the particular ingredients used. The presence of the moving particulate media in the vessel is needed to prepare the dispersion of toner particles. Useful particulate media are particulate materials, e.g., spherical, cylindrical, etc. selected from the group consisting of stainless steel, carbon steel, alumina, ceramic, zirconia, silica, and sillimanite. Carbon steel particulate media is particularly useful when colorants other than black are used. A typical diameter range for the particulate media is in the range of 0.04 to 0.5 inch (1.0 to approx. 13 mm).

After dispersing the ingredients in the vessel, with or without a polar additive present, until the desired dispersion is achieved, typically 0.5 to 2 hours with the mixture being fluid, the dispersion is cooled to permit precipitation of the resin out of the dispersant. Cooling is accomplished in the same vessel, such as the attritor, while simultaneously grinding with particulate media to prevent the formation of a gel or solid mass; without stirring to form a gel or solid mass, followed by shredding the gel or solid mass and grinding, e.g., by means of particulate media with or without the presence of additional liquid; or with stirring to form a viscous mixture and grinding by means of particulate media with or without the presence of additional liquid. Additional liquid may be added at any step during the preparation of the liquid electrostatic toners to facilitate grinding or to dilute the toner to the appropriate % solids needed for toning. Additional liquid means nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Toner particles of average particle size of less than 30 μm, as determined by a Malvern 3600E Particle Sizer, average particle size (by area) of less than 10 μm as determined using the Horiba centrifugal particle analyzer described above, or other comparable apparatus, are formed by grinding for a relatively short period of time.

The Malvern 3600E Particle Sizer manufactured by Malvern, Southborough, MA uses laser diffraction light scattering of stirred samples to determine average particle sizes. Since these two instrument use different techniques to measure average particle size the readings differ. The following correlation of the average size of toner particles in micrometers (μm) for the two instruments is:

| Value Determined By Malvern 3600E Particle Sizer | Expected Range For Horiba CAPA-500 |
|---|---|
| 30 | 9.9 ± 3.4 |
| 20 | 6.4 ± 1.9 |
| 15 | 4.6 ± 1.3 |
| 10 | 2.8 ± 0.8 |
| 5 | 1.0 ± 0.5 |
| 3 | 0.2 ± 0.6 |

This correlation is obtained by statistical analysis of average particle sizes for 67 liquid electrostatic developer samples (not of this invention) obtained on both instruments. The expected range of Horiba values was determined using a linear regression at a confidence level of 95%. In the claims appended to this specification the particle size values are as measured using the Horiba instrument.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion is reduced by the addition of additional nonpolar liquid as described previously above. The dilution is normally conducted to reduce the concentration of toner particles to between 0.1 to 15 percent by weight, preferably 0.3 to 3.0, and more preferably 0.5 to 2 weight percent with respect to the nonpolar liquid. One or more nonpolar liquid soluble ionic or zwitterionic charge director compounds, of the type set out above, can be added to impart a positive or negative charge, as desired. The addition may occur at any time during the process; preferably at the end of the process, e.g., after the particulate media are removed and the concentration of toner particles is accomplished. If a diluting nonpolar liquid is also added, the ionic or zwitterionic compound can be added prior to, concurrently with, or subsequent thereto. If an adjuvant compound of a type described above has not been previously added in the preparation of the developer, it can be added prior to or subsequent to the developer being charged, e.g., during or subsequent to dispersing step (B). Preferably the adjuvant compound is added after the dispersing step.

INDUSTRIAL APPLICABILITY

The improved process of this invention produces a liquid electrostatic developer. The developer contains toner particles having a controlled particle size range which can be prepared more quickly than by previously known processes for making liquid electrostatic developers. The developer is of the liquid type and is particularly useful in copying, e.g., making office copies of black and white as well as various colors; or in color proofing, e.g., making a reproduction of an image using the standard colors: yellow, cyan and magenta together with black as desired. In copying and proofing the toner particles are applied to a latent electrostatic image. Other uses are envisioned for the improved toner particles, e.g., the formation of copies or images using toner particles containing finely divided ferromagnetic materials or metal powders; conductive lines using toners containing conductive materials, resistors, capacitors and other electronic components; lithographic printing plates, etc.

EXAMPLES

The following controls and examples, wherein the parts and percentages are by weight, illustrate but do not limit the invention. In the examples the melt indices were determined by ASTM D 1238, Procedure A, the average particle sizes by area were determined using the Horiba CAPA 500 centrifugal particle analyzer, manufactured by Horiba Instruments Inc., Irving CA, as described above, the conductivity was measured in picomhos/cm (pmhos) at 5 Hertz and low voltage, 5 volts, and the density was measured using a Macbeth densitometer model RD918. The resolution is expressed in line pairs/mm (1p/mm).

The A-B diblock polymers were prepared using the procedures outlined below.

PREPARATION 1

A reaction vessel was charged with 432 g toluene, 5.05 g mesitylene, 8.76 g (0.05 mol) 1-ethoxy-1-trimethylsiloxy-2-methylpropene, and 1.5 ml of 0.33 M tetrabutylammonium-3-chlorobenzoate in acetonitrile/tetrahydrofuran (THF). Two feeds were begun simultaneously; 305.34 g (1.54 mol) 2-ethylhexyl methacrylate (EHMA) were added over 30 minutes, and 1.5 ml of 0.33 M tetrabutylammonium-3-chlorobenzoate in acetonitrile/THF in 4 g toluene were added over 90 minutes. Reaction of EHMA was followed by high pressure liquid chromatography. After all the EHMA had reacted (twenty minutes after the addition of the EHMA), 63.3 g (0.40 mol) of (trimethylsilyl) methacrylic acid (TMS-MAA) were added over 30 minutes. Sixteen hours after the addition of TMS-MAA, all the TMS-MAA monomer had reacted, and 45.4 g methanol, 26.3 g water and 1.4 g dichloroacetic acid were added to quench and remove the trimethylsilyl groups. After refluxing three hours, the methanol and toluene/water azeotrope were distilled off, and Isopar ®-L was added. The excess methanol was stripped off by distillation. The remaining solution was 50% solids; titration indicated 0.40 mmol acid/g solution. The diblock polymer prepared had a B block of poly(2-ethylhexyl methacrylate) wherein DP was 40 and an A block of poly(methacrylic acid) wherein DP was 8.

PREPARATION 2

The procedure of Preparation 1 was repeated with the following exception: instead of 305.34 g (1.54 mol) EHMA, 149 g (0.75 mol) was used. The diblock polymer prepared was had a B block of poly(2-ethyl-hexyl methacrylate) wherein DP was 20 and an A block of poly(methacrylic acid) wherein DP was 8.

PREPARATION 3

A reaction vessel was charged with 405 g Isopar ®-L, 32.8 g toluene, 5.05 g mesitylene, 10.4 g (0.06 mol) 1-ethoxy-1-trimethylsiloxy-2-methylpropene, and 1.5 ml of 0.33 M tetrabutylammonium-3-chlorobenzoate in acetonitrile/tetrahydrofuran (THF). Two feeds were begun simultaneously; a mixture of 403.8 g (2.03 mol) 2-ethylhexyl methacrylate (EHMA) and 68.6 g (0.43 mol) of (trimethylsilyl) methacrylic acid (TMS-MAA) were added over 30 minutes, and 1.5 ml of 0.33 M tetrabutylammonium-3-chlorobenzoate in acetonitrile/THF in 4 g toluene were added over 90 minutes. Reaction of EHMA and TMS-MAA was followed by high pressure liquid chromatography. The monomers were allowed to react to completion overnight. Then 45.4 g methanol, 26.3 g water and 1.4 g dichloroacetic acid were added to quench and remove the trimethylsilyl groups. After refluxing three hours, the methanol and toluene/water azeotrope were distilled off, and sufficient Isopar ®-L to make the final solution 50% solids was added. Titration indicated 0.94 mmol acid/g solution. The random copolymer prepared was poly(2-ethylhexyl methacrylate), DP =40, and poly(methacrylic acid), DP =8.

CONTROL 1

In a Union Process 01 Attritor, Union Process Company, Akron, OH, were placed the following ingredients:

| INGREDIENT | AMOUNT (g) |
|---|---|
| Terpolymer of methyl acrylate (67.3%), methacrylic acid (3.1%), and ethylhexyl acrylate (29.6%), weight average molecular weight 172,000, acid no. 13 | 35 |
| Uhlich ® 8200 pigment, Paul Uhlich & Co., Hastings-on-Hudson, New York | 9 |
| Lubrizol ® 2155, Lubrizol Corporation, Wickliff, OH | 5 |
| Isopar ®-L, non-polar liquid having Kauri-butanol value of 27 (Exxon Corp.) | 200 |

The ingredients were heated to 100 +/−10° C. in the attritor and milled with 0.1875 inch (4.76 mm) diameter stainless steel balls for 2.5 hours. The attritor was cooled to room temperature and milling was continued until particle size minimized (14 hours), to obtain toner particles with an average particle size by area of 0.73 μm. The particulate media were removed and the dispersion of toner particles was then diluted to 1 percent solids with additional Isopar ®-L. To 1.5 kg of this dispersion were 5% solution of Emphos ®D70-30C., an anionic glyceride positive charge director. Medical hard copy images of the resulting toner had very good image quality, with little flow and good resolution.

CONTROL 2

The procedure of Control 1 was repeated with the following exceptions: the pigment, Isopar ®, and 13.5 g of the acid-containing random copolymer described in Preparation 3 were ground together for 1 hour. The remaining ingredients were then added, and were hot ground for 1.5 hours. The attritor was cooled to room temperature, and milling was continued for 18 hours to obtain toner particles with an average particle size by area of 0.80 μm.

CONTROL 3

The procedure of Control 1 was repeated with the following exceptions: instead of the acrylic terpolymer resin, a copolymer of ethylene (89%) and methacrylic acid (11%), melt index a 190° C. is 100, acid no. is 66, was used; instead of 2.5 hours, hot grind time was 1.5 hours. The attritor was cooled to room temperature, and milling was continued until particle size minimized (14 hours) to 1.01 μm.

EXAMPLE 1

The procedure of Control 2 was repeated with the following exceptions: instead of pregrinding with the random copolymer, the A-B diblock polymer described in Preparation 1 was used. Instead of a 1.5 hour hot grind, the components were hot ground for 1 hour. The attritor was cooled to room temperature, and milling was continued until particle size minimized (4.5 hours) to 0.93 μm. The particulate media were removed and the dispersion of toner particles was then diluted to 1 percent solids with additional Isopar ®-L. To 1.5 kg of this dispersion were added 30 g of a 5% solution of Emphos ®D70-30C., an anionic glyceride positive charge director. Medical hard copy images of the resulting toner were comparable in every way to images made with the toner described in Control 1.

EXAMPLE 2

The procedure of Example 1 was repeated with the following exceptions: instead of 1 hour, hot grind time was 1.5 hours. Instead of the diblock polymer described in Preparation 1, the lower molecular weight diblock polymer described in Preparation 2 was used. Particle size minimized after 6 hours cold grind to 0.85 μm. Medical hard copy images of the resulting toner were comparable in every way to images made with the toner described in Control 1.

EXAMPLE 3

The procedure of Example 1 was repeated with the following exceptions: instead of 1 hour, hot grind time was 1.5 hours. Instead of Uhlich ®8200 black pigment, Heucophthal Blue ®XBT-58D (Heubach Inc., Newark, NJ) was used. Particle size minimized to 0.92 μm after 8 hours cold grind time. Medical hard copy images of the resulting toner were comparable in every way to images made with the toner described in Control 1.

EXAMPLE 4

The procedure of Control 3 was repeated with the following exception: the pigment and Isopar ®were preground at room temperature for 1 hour with 13.5 g of the acid-containing A-B diblock polymer described in Preparation 1. Particle size minimized to 0.93 μm after 4 hours cold grind time. Medical hard copy images of the resulting toner were comparable in every way to images made with the toner described in Control 1.

The results of the controls and examples are set out in Table 1 below.

TABLE 1

| EXAMPLE OR CONTROL | GRINDING AID | COLD GRIND (HOURS) | PARTICLE SIZE (μm) |
|---|---|---|---|
| C1 | NONE | 14 | 0.73 |
| C2 | PREP 3 | 18 | 0.80 |
| C3 | NONE | 14 | 1.01 |
| E1 | PREP 1 | 4.5 | 0.93 |
| E2 | PREP 2 | 6 | 0.85 |
| E3 | PREP 1 | 8 | 0.92 |
| E4 | PREP 1 | 4 | 0.93 |

EXAMPLE 5

The procedure of Example 1 is repeated with the following exceptions: instead of a Union Process Attritor, a Ross double planetary jacketed mixer, Model No. LDM, Charles Ross & Son Company, Hauppauge, NY is used. The amount of the copolymer used is 500 g. The amount of pigment used is 166 g, and the amount of Isopar ®-L used is 250 g. The ingredients are heated to 90° C. +/−10° C. and stirred at the maximum rate for 30 minutes. 1750 g of Isopar ®-L is slowly added to the ingredients over a two hour period while maintaining the temperature at 90° C. +/−10° C. Upon completion of the addition of Isopar ®-L, the mixture is cooled to room temperature with continued stirring at the maximum rate. The desired particle size is achieved in a shorter time than is achieved in the absence of an A-B diblock polymer.

EXAMPLE 6

The procedure of Example 5 is repeated with the following exceptions: after the 1750 g of Isopar ®-L is added, the homogenous mixture is discharged to a shallow metal pan and cooled to room temperature to give a gelatinous material, which is sliced into small strips and ground up, using a General Slicing meat grinder (manufactured by General Slicing/Red Goat Dispensers, Murfreesboro, TN). Isopar ®-L and 665 g of the ground material are charged to a 1-S Attritor for final particle size reduction. Milling is continued until the required particle size is achieved. The desired particle size is achieved in a shorter time than is achieved in the absence of an A-B diblock polymer.

We claim:

1. A process for preparing liquid electrostatic developers for electrostatic imaging comprising:

(A) dispersing at ambient temperature in a vessel, a colorant, a nonpolar liquid having a Kauri-butanol value of less than 30 and an A-B diblock polymer wherein the A block is a carboxylic acid-containing polymer, the B block is a polymer or copolymer which is soluble in the nonpolar liquid;

(B) adding to the dispersion a thermoplastic resin and dispersing at an elevated temperature sufficient to plasticize and liquify the resin and below that at which the nonpolar liquid degrades and the resin and/or colorant decomposes;

(C) cooling the dispersion, either (1) without stirring to form a gel or solid mass and grinding by means of particulate media;

(2) with stirring to form a viscous mixture and grinding by means of particulate media; or (3) while grinding by means of particulate media to prevent the formation of a gel or solid mass;

(D) separating the dispersion of toner particles having an average by area particle size of less than 10 μm from the particulate media, and (E) adding to the dispersion during or subsequent to Step (B) at least one nonpolar liquid soluble ionic or zwitterionic charge director compound.

2. A process according to claim 1 wherein the A block of the A-B diblock polymer is a polymer prepared from a monomer selected from the group consisting of alkyl, substituted alkyl, aryl, substituted aryl, alkylaryl and substituted alkylaryl carboxylic acid.

3. A process according to claim 1 wherein the B block of the A-B diblock polymer is a polymer prepared from at least one monomer selected from the group consisting of butadiene, isoprene and compounds of the general formulas: CH2=CCH3CO2R and CH250 CHCO2R wherein R is alkyl of 8 to 30 carbon atoms.

4. A process according to claim 1 wherein the A-B diblock polymer is selected from the group consisting of polymethacrylic acid and polyethylhexyl methacrylate, poly(4-vinyl benzoic acid) and polybutadiene; polyacrylic acid and polylauryl methacrylate; polymethacrylic acid and ethylhexyl acrylate; poly(2-vinyl benzoic acid) and polyisoprene; and poly(3-vinyl benzoic acid) and polystearyl methacrylate.

5. A process according to claim 1 wherein the A-B diblock polymer is present in an amount of 5 to 40% by weight of developer solids.

6. A process according to claim 1 wherein the A block is present in an amount of 5 to 40% by weight based on the total weight of the A-B diblock polymer.

7. A process according to claim 1 wherein the A-B diblock polymer is polymethacrylic acid wherein degree of polymerization is 8 and poly(2-ethylhexyl) methacrylate wherein degree of polymerization is 40.

8. A process according to claim 1 wherein the A-B diblock polymer is polymethacrylic acid wherein degree of polymerization is 8 and poly(2-ethylhexyl) methacrylate wherein degree of polymerization is 20.

9. A process according to claim 1 wherein there is present in the vessel up to 100% by weight of a polar liquid having a Kauri-butanol value of at least 30, the percentage based on the total weight of the developer liquid.

10. A process according to claim 1 wherein the particulate media are selected from the group consisting of stainless steel, carbon steel, ceramic, alumina, zirconia, silica and sillimanite.

11. A process according to claim 1 wherein the thermoplastic resin is a copolymer of ethylene and an α,β-ethylenically unsaturated acid selected from the group consisting of acrylic acid and methacrylic acid.

12. A process according to claim 1 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

13. A process according to claim 12 wherein the thermoplastic resin is a copolymer of ethylene (89%)/methacrylic acid (11%) having a melt index at 190° C.

14. A process according to claim 1 wherein the thermoplastic resin component is a copolymer of acrylic or methacrylic acid and at least one alkyl ester of acrylic or methacrylic acid wherein alkyl is 1 to 20 carbon atoms.

15. A process according to claim 14 wherein the thermoplastic resin component is a copolymer of methyl methacrylate (50–90%)/methacrylic acid (0–20%)/ethylhexyl acrylate (10–50%).

16. A process according to claim 1 wherein additional nonpolar liquid, polar liquid, or combinations thereof is present to reduce the concentration of toner particles to between 0.1 to 15 percent by weight with respect to the developer liquid.

17. A process according to claim 16 wherein the concentration of toner particles is reduced by additional nonpolar liquid.

18. A process according to claim 1 wherein cooling the dispersion is accomplished while grinding by means of particulate media to prevent the formation of a gel or solid mass with or without the presence of additional liquid.

19. A process according to claim 1 wherein cooling the dispersion is accomplished without stirring to form a gel or solid mass, followed by shredding the gel or solid mass and grinding by means of particulate media with or without the presence of additional liquid.

20. A process according to claim 1 wherein cooling the dispersion is accomplished with stirring to form a viscous mixture and grinding by means of particulate media with or without the presence of additional liquid.

21. A process according to claim 1 wherein an adjuvant compound selected from the group consisting of polyhydroxy compound, aminoalcohol, polybutylene succinimide, metallic soap, and an aromatic hydrocarbon is added during the dispersing step (B) or subsequent thereto.

22. A process according to claim 21 wherein the adjuvant compound is an aminoalcohol.

23. A process according to claim 16 wherein an adjuvant compound selected from the group consisting of polyhydroxy compound, aminoalcohol, polybutylene succinimide, metallic soap, and an aromatic hydrocarbon is added.

24. A process according to claim 23 wherein the adjuvant compound is a polyhydroxy compound.

25. A process according to claim 23 wherein the adjuvant compound is a metallic soap dispersed in the thermoplastic resin.

26. A process according to claim 25 wherein the metallic soap adjuvant compound is an aluminium stearate.

27. A process according to claim 1 wherein the colorant is present in an amount up to about 60% by weight based on the total weight of developer solids.

28. A process according to claim 27 wherein the colorant is a pigment.

29. A process according to claim 1 wherein the colorant is added after homogenizing the thermoplastic resin and nonpolar liquid.

30. A process according to claim 1 wherein the charge director compound is lecithin.

31. A process according to claim 1 wherein the charge director compound is an oil-soluble petroleum sulfonate.

32. A process according to claim 1 wherein the charge director compound is an anionic glyceride.

33. A process according to claim 1 wherein the developer particles have an average particle size of about 1 μm or less.

34. A process for preparing liquid electrostatic developers for electrostatic imaging comprising:

(A) dispersing at an elevated temperature in a vessel a thermoplastic resin, a colorant, a nonpolar liquid having a Kauri-butanol value of less than 30 and an A-B diblock polymer wherein the A block is a carboxylic acid-containing polymer, the B block is a polymer or copolymer which is soluble in the nonpolar liquid, while maintaining the temperature in the vessel at a temperature sufficient to plasticize and liquify the resin and below that at which the nonpolar liquid degrades and the resin and/or colorant decomposes;

(B) cooling the dispersion, either
  (1) without stirring to form a gel or solid mass and grinding by means of particulate media;
  (2) with stirring to form a viscous mixture and grinding by means of particulate media; or
  (3) while grinding by means of particulate media to prevent the formation of a gel or solid mass;

(C) separating the dispersion of toner particles having an average by area particle size of less than 10 μm from the particulate media, and (D) adding to the dispersion during or subsequent to Step (A) at least one nonpolar liquid soluble ionic or zwitterionic charge director compound.

35. A process according to claim 34 wherein the A block of the A-B diblock polymer is a polymer prepared from a monomer selected from the group consisting of alkyl, substituted alkyl, aryl, substituted aryl, alkylaryl and substituted alkylaryl carboxylic acid.

36. A process according to claim 34 wherein the B block of the A-B diblock polymer is a polymer prepared from at least one monomer selected from the group consisting of butadiene, isoprene and compounds of the general formulas: $CH_2{=}CCH_3CO_2R$ and $CH_2{=}CHCO_2R$ wherein R is alkyl of 8 to 30 carbon atoms.

37. A process according to claim 34 wherein the A-B diblock polymer is selected from the group consisting of polymethacrylic acid and polyethylhexyl methacrylate, poly(4-vinyl benzoic acid) and polybutadiene; polyacrylic acid and polylauryl methacrylate; polymethacrylic acid and ethylhexyl acrylate; poly(2-vinyl benzoic acid) and polyisoprene; and poly(3-vinyl benzoic acid) and polystearyl methacrylate.

38. A process according to claim 34 wherein the A-B diblock polymer is present in an amount of 5 to 40% by weight of developer solids.

39. A process according to claim 34 wherein the A block is present in an amount of 5 to 40% by weight based on the total weight of the A-B diblock polymer.

40. A process according to claim 34 wherein the A-B diblock polymer is polymethacrylic acid wherein degree of polymerization is 8 and poly(2-ethylhexyl) methacrylate wherein degree of polymerization is 40.

41. A process according to claim 34 wherein the A-B diblock polymer is polymethacrylic acid wherein degree of polymerization is 8 and poly(2-ethylhexyl) methacrylate wherein degree of polymerization is 20.

42. A process according to claim 34 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

* * * * *